United States Patent [19]

Luke

[11] Patent Number: 4,535,793

[45] Date of Patent: Aug. 20, 1985

[54] SMOKING ARTICLE FILTERS

[75] Inventor: John A. Luke, Eastleigh, England

[73] Assignee: Brown & Williamson Tobacco Corporation, Louisville, Ky.

[21] Appl. No.: 514,990

[22] Filed: Jul. 18, 1983

[30] Foreign Application Priority Data

Aug. 18, 1982 [GB] United Kingdom ..... 8223775

[51] Int. Cl.[3] ..... A24D 3/04

[52] U.S. Cl. ..... 131/336; 131/361

[58] Field of Search ..... 131/361, 363, 336, 339, 131/340

[56] References Cited

U.S. PATENT DOCUMENTS 4,232,574 11/1980 Hall ..... 131/336

*Primary Examiner*—V. Millin

*Attorney, Agent, or Firm*—Charles G. Lamb

[57] ABSTRACT

A ventilated filter element comprising a fibrous filter element wherein a plurality of equiangularly spaced apart grooves extend in a parallel fashion along the longitudinal axis of the filter element from the mouth end of the element for a distance less than the total length of the element.

8 Claims, 3 Drawing Figures

SMOKING ARTICLE FILTERS

This invention relates to tobacco-smoke filters, for cigarettes for example, and to the manufacture thereof.

Various cigarette filters have been proposed which comprise a plug of filtration material provided with one or more depressions in the peripheral surface of the plug. In the specification of our United Kingdom Patent No. 1,592,549 there is described a filter having a self-bonded filter plug, i.e. a non-wrapped plug, which is provided with a comparatively deep depression in the form of an annular groove. It is essential for the proper performance of the filtration mechanism of this filter that the walls of the annular groove are substantially impervious to tobacco smoke. According to the teaching of Specification No. 1,592,549 the annular groove is formed by revolving the filter plug against a blade which is maintained at a temperature sufficient to melt the filtration material of which the plug is composed. In some circumstances the walls of the groove will be glazed by the hot blade and thereby rendered at least partially impervious to tobacco smoke. In practice it has been found advantageous to introduce a sealant material into the groove to ensure that the walls thereof possess the required degree of imperviousness. Apparatus operable to introduce sealant material into annular grooves is described in United Kingdom Patent Specification No. 2,033,207A. The use of a sealant material increases the cost and complexity of filter plug manufacture.

In the manufacture of filter tipped cigarettes it is the usual current practice to use wrapped rather than non-wrapped filter plugs. A wrapped plug comprises filtration material, commonly cellulose acetate fibres, wrapped in a plugwrap. The plugwrap is most usually a paper composed mainly of cellulosic fibres, although proposals have been made for plugwraps the constitution of which comprises a proportion of thermoplastic fibres. Plugwraps of the latter type are disclosed in United Kingdom Patent Specifications Nos. 2,056,841A and 2,058,543A.

It is an object of the present invention to provide a method for manufacturing filter plugs having surface depressions of a tobacco-smoke perviousness of a low order, without relying on heat glazing or using a sealant.

The present invention provides a method of manufacture of filter rod, wherein filtration material and plugwrap are fed continuously to a rod maker, said plugwrap being a thermally mouldable paperlike material, and bringing the resultant rod into contact with a heated moulding means to thereby produce an impression in the peripheral surface of said rod whilst preserving the continuity of said plugwrap.

The present invention also provides filter rod comprising filtration material wrapped in a plugwrap of a thermally mouldable paperlike material, said rod comprising a thermally moulded impression in the peripheral surface thereof and said plugwrap providing a continuous lining of said impression.

The plugwrap possesses its characteristic of thermal mouldability by virtue of the inclusion therein of not less than 30% by weight of synthetic thermoplastic material, a substantial proportion at least of which is suitably in the form of fibrillated fibre. Advantageously, the inclusion level of thermoplastic material is in a range of 45% to 95%. At least a substantial proportion of the balance to 100% should be of cellulosic fibres.

When a filter rod is manufactured in accordance with the present invention, the area of the plugwrap lining the impression may be three times, or even more, the superficial area of the impression. Obviously, that portion of the plugwrap which is subjected to thermal moulding in the production of the impression is reduced in thickness as it is extended in area. The relative movement between the moulding means and the filter rod may take place in a single direction, radially of the rod for example, or it may take place with components in two directions. Thus, for instance, there may be imposed on a radial relative movement, a rotary relative movement about the rod axis. In the process of causing the redistribution of material originally forming part of the plugwrap at the periphery of the filter rod, the heated moulding means also produces an at least partial fusion of the thermoplastic content. With plugwraps containing thermoplastic material of a sufficiently low melting point, polyethylene or cellulose acetate for example, the permeability can be reduced in this manner to low values, even substantially to zero. The fusion effect is dependent on the amount of heat transferred from the moulding means to the plugwrap, this being a function of temperature and time of contact. Too high a temperature will cause degradation of the plugwrap material, resulting in destruction of the integrity thereof.

If a thermally moulded impression is a comparatively deep one, the moulding process may readily result in a transformation of the plugwrap from a paperlike material to a filmlike material of low permeability. This transformation results from the effect of the thermal moulding process on the thermoplastic content of the plugwrap, the cellulosic fibres being unaffected by the heat. This filmlike material may be thermally bonded to the underlying filtration material. In the case of a shallow thermally moulded impression, such transformation of the plugwrap may not occur, or only occur to a slight extent, since the material of the plugwrap is subjected to only a limited degree of redistribution. Thus if it is required that the portion of plugwrap lining a shallow groove is of low permeability, it may be appropriate to use plugwrap which has been manufactured with an initial permeability of low value. Plugwrap having an initial permeability not greater than 100 Coresta units, for example, could be used. When, on the other hand, a deep impression is to be formed, plugwraps of higher initial permeability may be usable, since the fusion/-redistribution transformation of the portion of the plugwrap subjected to the groove-forming moulding process will effect a marked reduction in the permeability of that portion.

In order to ensure acceptable runnability on a filter-rod making machine, the plugwrap should have a minimum tensile strength, measured along any axis, of at least 8 Newtons per 25 millimeters of width transverse to the measurement axis.

The thickness of the plugwrap should not exceed 140 microns. The weight of the plugwrap should not exceed 80 grammes per square meter and is suitably less than 50 grammes per square meter.

The synthetic thermoplastic content of the plugwrap which is in fibrous form may be supplemented by an inclusion of synthetic thermoplastic material in particulate form. The fibrous and/or the particulate thermoplastic content may comprise more than one thermoplastic material.

The cellulosic fibres in the plugwrap may, for example, be of bleached softwood sulphate, bleached sulphite or cotton linters. Loadings of papermaking additives such as titanium dioxide or calcium carbonate may also be included.

The invention will now be described by way of example with reference to the accompanying drawing, which shows, in axial section, a portion of the length of a cigarette filter rod.

Crimped cellulose acetate tow, as filtration material, and plugwrap were fed continuously to a Hauni KDF 2 filter-rod making machine to produce filter rod 1 of 24.8 millimeters circumference comprising tow 2 wrapped in plugwrap 3. The tow 2 was plasticised using triacetin and the plugwrap 3 was seam sealed using a polyvinyl acetate adhesive.

The plugwrap 3 was a paperlike material comprising 50% by weight of fibrillated fibres of polyethylene, designated Pulpex E, and 50% cellulosic fibres designated Stora 32. The weight of the plugwrap was 37 grammes per square meter. As a final step in the making process thereof, the plugwrap was subjected to infrared heating at 180° C. for 3 minutes to effect consolidation. Post consolidation, the permeability of the plugwrap was 60 Coresta units, the thickness was 90 microns, and the tensile strength was 34 Newtons/25 millimeters width in the machine direction and 24 Newtons/25 millimeters width in the cross direction.

The filter rod 1 produced by the filter-rod maker was cut into lengths equivalent to six filter plug lengths. Thermal moulding apparatus generally similar to that described in the specification of our United Kingdom Patent No. 1,507,765 was then employed to mould deep annular grooves into each of the rod lengths. One such groove, having reference numeral 4, is indicated in the drawing. After completion of the thermal moulding step the plugwrap 3 maintained its integrity and thus served to provide a continuous lining to the groove 4. It may be noted that the continuity of the plugwrap 3 is preserved notwithstanding the sharpness of the outer corners 5, 6 of the groove 4. The thermal moulding step producing the groove 4 resulted in a reduction of the permeability, to substantially zero, of that portion of the plugwrap lining the groove 4, said portion having been transformed from a paperlike material to a filmlike material.

Details of seven further plugwrap materials acceptable for use in the manufacturing method according to the invention are given in the table. The plugwrap designated Example 6 in the table could also be used after having been sized in order to reduce the permeability of the plugwrap. It was found that using polyvinyl alcohol as a size, the permeability of the Example 6 material could be reduced to 83 Coresta units.

Since the plugwraps contain a proportion of thermoplastic material, as an alternative to using an adhesive to seam seal them, they can be sealed by the application of heat.

| Examples | Furnish: Synthetic Pulp % | Furnish: Cellulosic Pulp % | Post Consolidation Tensile Strength (Newtons/25 mm Width): Machine Direction | Post Consolidation Tensile Strength (Newtons/25 mm Width): Cross Direction | Post Consolidation Permeability (cc/min/cm$^2$ at 10 cms W. G.) | Grammage (gms/m$^2$) | Post Consolidation Thickness (Microns) |
|---|---|---|---|---|---|---|---|
| 1 | 75% | | 34 | 19 | 3 | 36 | 90 |
| 2 | Solvay | | 28 | 17 | 50 | 30 | 75 |
| 3 | Pulpex E | 25% Stora 32 | 29 | 18 | 25 | 37 | 82 |
| 4 | (Poly- | | 36 | 22 | 16 | 38 | 85 |
| 5 | ethylene) | | 37 | 17 | 10 | 45 | 99 |
| 6 | 75% Solvay Pulpex P (Poly-propylene) | 25% Stora 32 | 15 | 9 | 4,080 | 35 | 134 |
| 7 | 80% Cellulose Acetate | 20% Wood Pulp | 18 | 10 | 24,500 | 41 | 94 |

I claim:

1. A smoking article ventilated filter element comprising a plug of fibrous filtration material wrapped in an air permeable wrapper, a plurality of equiangularly spaced apart grooves extending parallel to the longitudinal axis of the filter element from the mouth end of the element for a distance less than the total length of the element, each groove being defined in the wrapper by a longitudinal strip of wrapper being removed exposing the fibrous material of the plug.

2. A smoking article ventilated filter element comprising a plug of fibrous filtration material wrapped in an air impermeable, outer wrapper, a further air impermeable wrapper intermediate said plug of filtration material and said outer wrapper, a plurality of equiangularly spaced apart grooves extending parallel to the longitudinal axis of the filter element from the mouth end of the element for a distance less that the total length of the element, each groove being defined in the outer wrapper by a longitudinal strip of outer wrapper being removed exposing the intermediate wrapper.

3. A filter element according to claim 1, wherein said wrapper is a thermoplastic material.

4. A filter element according to claim 2, wherein said outer wrapper is a thermoplastic material, and said intermediate wrapper is a thermoplastic material.

5. A smoking article comprising a rod of smoking material, a filter plug element and a tipping wrapper serving to interattach said rod and plug element, which element comprises a plug of fibrous filtration material wrapped in an air impermeable outer wrapper, a plurality of equiangularly spaced apart grooves extending parallel to the longitudinal axis of the filter element from the mouth end of the element for a distance less than the total length of the element, each groove being defined in the outer wrapper by a longitudinal strip of the outer wrapper being removed exposing the fibrous filtration material of the plug, and the tipping wrapper being provided with a ring of spaced ventilation perforations disposed to communicate with said grooves at the upstream region thereof.

6. A smoking article according to claim 5, wherein the filter-plug element further comprises a further air impermeable wrapper intermediate the plug of filtration material and the outer air impermeable wrapper, the removed strips of material from the outer wrapper defining the grooves exposing the intermediate wrapper.

7. A smoking article according to claim 6 and further provided with an annular groove from which the said channel means extend.

8. A smoking article comprising a rod of smoking material, a filter-plug and a tipping wrapper serving to interattach said rod and plug element, which element comprises a plug of fibrous filtration material wrapped in an air impermeable wrapper, two channel means following helical intersecting paths defined in the wrapper by corresponding helical strips of the wrapper being removed exposing the fibrous filtration material of the plug, and the tipping wrapper being provided with a ring of perforations disposed to communicate with said grooves at the upstream regions thereof.

* * * * *

UNITED STATES PATENT AND TRADEMARK OFFICE

CERTIFICATE OF CORRECTION

PATENT NO. : 4,535,793

DATED : August 20, 1985

INVENTOR(S) : John A. Luke

It is certified that error appears in the above-identified patent and that said Letters Patent is hereby corrected as shown below:

Column 1, line 4, beginning with "This invention relates to tobacco-smoke filters," delete all to and including "the upstream region thereof." in column 4, line 41 and insert the following:

Signed and Sealed this

*Twenty-second* Day of *July 1986*

[SEAL]

*Attest:*

DONALD J. QUIGG

*Attesting Officer*

*Commissioner of Patents and Trademarks*

BACKGROUND OF THE INVENTION

This invention relates to ventilated filter-tipped cigarettes.

It is known to provide cigarettes with filters comprising smoke-filtration means, commonly in the form of a plug of fibrous filtration material, and ventilation-channel means extending to the mouth end of the filter, the outer wrapper enwrapping the filter being such as to permit ingress of air into the channel means. When a cigarette provided with such a filter is smoked, air wholly or substantially unmixed with tobacco smoke enters the smoker's mouth from the channel means together with tobacco smoke from the filtration means. It has been found that the segregation of air and smoke in this manner enhances the smoking characteristics of the cigarette.

A segregated ventilation filter is described in United Kingdom Patent Specification No. 2,090,117A. The filter there described comprises a filter plug enwrapped in a first plugwrap which is overlain by a second plugwrap. The second plugwrap is modified by cutting or crimping prior to its being wrapped about the first plugwrap. The form of the modification to the second plugwrap is such that when a tipping wrapper is enwrapped about the second plugwrap, ventilation-air channels, extending to and opening at the mouth end of the filter, are defined. Perforation holes are provided in the tipping wrapper to permit ventilation air to enter the channels.

SUMMARY OF THE INVENTION

The present invention provides a filter element comprising fibrous filtration material wrapped in a wrapper a portion(s) of which wrapper extending to an end of said element having been removed by moving said element and heated forming means relatively of each other and in contact with each other.

The present invention also provides a smoking article, a cigarette for example, comprising a rod of smoking material, a filter element and a tipping wrapper serving to interattach said rod and said filter element, said filter element comprising fibrous filtration material wrapped in a wrapper a portion(s) of which wrapper extending to the mouth end of said element having been removed by moving said element and heated forming means relatively of each other and in contact with each other, the removal of said portion(s) of said wrapper providing a ventilation-air distribution channel(s) bounded by said tipping wrapper and opening at said mouth end of said element, and said tipping wrapper permitting the ingress of ventilation air into said channel(s) upstream of said mouth end.

The removal of the portion(s) of the filter wrapper exposes either the underlying filtration material or a further wrapper intermediate the filtration material and the wrapper from which the portion(s) is removed. The filter wrapper, or the outer wrapper when a further, intermediate wrapper is provided, may be of conventional paper plugwrap material or it may be of a material of a thermoplastic character by having incorporated in it a proportion of thermoplastic fibres or by being a thermoplastic film material. Similarly, when an intermediate wrapper is provided, it may be of conventional paper plugwrap material or it may be of a material of a thermoplastic character. Suitable materials for thermoplastic fibres and thermoplastic film include cellulose acetate, polyethylene, polypropylene and cellophane. Conveniently, in order to effect removal of the wrapper portion(s) a filter rod, of a length a multiple of a unit filter element, and heated forming means are moved relatively of each other in an arcuate path, although a straight path of relative movement would also be appropriate.

BRIEF DESCRIPTION OF THE DRAWING

In order that the invention may be clearly understood and readily carried into effect, reference will now be made, by way of example, to the accompanying diagrammatic drawing, in which.

DETAILED DESCRIPTION OF THE PREFERRED EMBODIMENT

Figure 1:
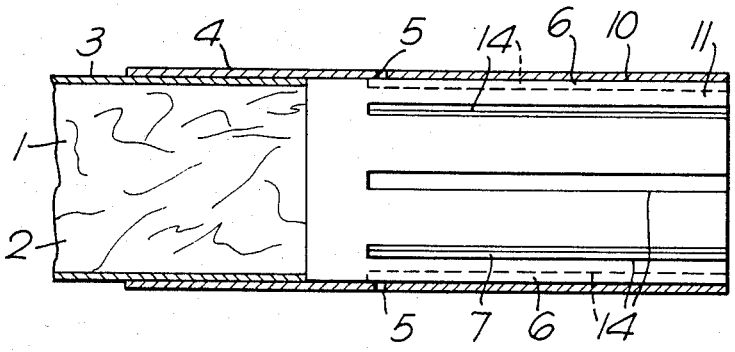
FIG. 1 shows parts of a filter tipped cigarette, a tipping wrapper and part of a tobacco rod thereof being shown in axial section.

The filter tipped cigarette of FIG. 1 comprises a cigarette rod 1, of tobacco filler 2 wrapped in a cigarette paper wrapper 3, a filter element 10, of fibrous cellulose acetate filtration material wrapped in paper plugwrap 11, and a paper tipping wrapper 4 serving to interattach the cigarette rod 1 and the filter element 10.

Prior to being incorporated in the cigarette of FIG. 1 the filter element 10 formed part of a filter rod of a length equivalent to, for example, six unit elements. The rod was rolled in contact with a heated former (not shown) of such configuration as to effect removal, by burning, of a number of grooves 14 equiangularly spaced about the element 10. Each of the grooves 14 extends parallel to the axis of the element 10 from an upstream location of the element to the mouth end of the element.

The tipping wrapper 4 is provided with a ring of ventilation perforations 5, the ring being so located along the element 10 and the perforations 5 being of such size and spacing that at least one of the perforations 5 communicates with each of the grooves 14 at an upstream end region thereof. The grooves 14, together with the tipping wrapper 4 and the cellulose acetate filtration material exposed within the area of each groove 14, and designated 7, define ventilation-air distribution channels 6. Thus during smoking of the cigarette, ventilation air may enter the channels 6 through the perforations 5 and flow to the smoker's mouth therealong.

Figure 2:
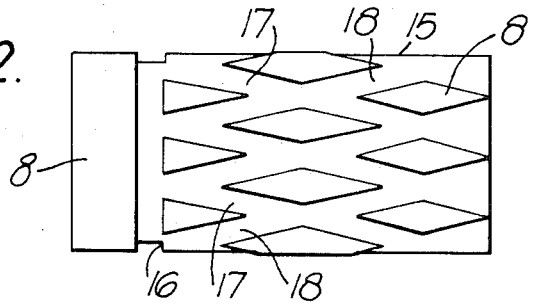
FIG. 2 shows a filter element which could be substituted for the filter element of the cigarette of FIG. 1.
Figure 3:
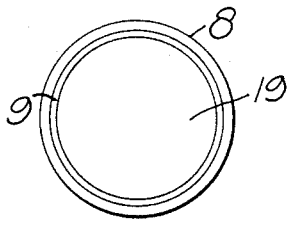
FIG. 3 shows a mouth-end view of the filter element of FIG. 2.

A form of filter element 15 alternative to the element 10 of FIG. 1 is shown in FIGS. 2 and 3. The filter element 15 comprises a thermoplastic film wrapper 8, fibrous filtration material 19, and a further wrapper 9 intermediate the wrapper 8 and the filtration material 19. A six times unit length filter rod from which the element 15 was cut was rolled in contact with a heated former of such configuration as to remove portions from the wrapper 8 to provide an annular groove 16 and extending therefrom two series of grooves 17, 18 which follow helical paths of opposite hand and extend to and open at the mouth end of the element 15, i.e., the right-hand end viewing FIG. 2. The grooves 16–18 are not so deep as to extend through the wrapper 9.

When the filter element 15 is attached to a cigarette rod by tipping having ventilation perforations in communication with the annular groove 16, ventilation air can flow from the groove 16 into the grooves 17, 18 and therefrom into the smoker's mouth.

The wrapper 9 may be of conventional paper plugwrap material but is suitably of a paper containing thermoplastic fibres or is a thermoplastic film material. The wrapper 9 may be of low or substantially zero air permeability.

An apparatus of a type which could be utilized for heat removal of portions of plugwrap is described in United Kingdom Patent Specification No. 1,507,765.

Although the formation of the grooves 17, 18 by the thermal removal of thermoplastic film plugwrap results in the production of small isolated triangular and diamond shaped portions of the remaining plugwrap, these portions are firmly secured to the underlying body of filtration material because the margins of these portions become thermally bonded to the filtration material during the thermal formation of the grooves 17, 18.

I claim:

1. A smoking article ventilated filter element comprising a plug of fibrous filtration material wrapped in an air permeable wrapper, a plurality of equiangularly spaced apart grooves extending parallel to the longitudinal axis of the filter element from the mouth end of the element for a distance less than the total length of the element, each groove being defined in the wrapper by a longitudinal strip of wrapper being removed exposing the fibrous material of the plug.

2. A smoking article ventilated filter element comprising a plug of fibrous filtration material wrapped in an air impermeable, outer wrapper, a further air impermeable wrapper intermediate said plug of filtration material and said outer wrapper, a plurality of equiangularly spaced apart grooves extending parallel to the longitudinal axis of the filter element from the mouth end of the element for a distance less than the total length of the element, each groove being defined in the outer wrapper by a longitudinal strip of outer wrapper being removed exposing the intermediate wrapper.

3. A filter element according to claim 1, wherein said wrapper is a thermoplastic material.

4. A filter element according to claim 2, wherein said outer wrapper is a thermoplastic material, and said intermediate wrapper is a thermoplastic material.

5. A smoking article comprising a rod of smoking material, a filter plug element and a tipping wrapper serving to interattach said rod and plug element, which element comprises a plug of fibrous filtration material wrapped in an air impermeable outer wrapper, a plurality of equiangularly spaced apart grooves extending parallel to the longitudinal axis of the filter element from the mouth end of the element for a distance less than the total length of the element, each groove being defined in the outer wrapper by a longitudinal strip of the outer wrapper being removed exposing the fibrous filtration material of the plug, and the tipping wrapper being provided with a ring of spaced ventilation perforations disposed to communicate with said grooves at the upstream region thereof.

6. A smoking article according to claim 5, wherein the filter-plug element further comprises a further air impermeable wrapper intermediate the plug of filtration material and the outer air impermeable wrapper, the removed strips of material from the outer wrapper defining the grooves exposing the intermediate wrapper.

7. A smoking article according to claim 6 and further provided with an annular groove from which the said channel means extend.

8. A smoking article comprising a rod of smoking material, a filter-plug and a tipping wrapper serving to interattach said rod and plug element, which element comprises a plug of fibrous filtration material wrapped in an air impermeable wrapper, two channel means following helical intersecting paths defined in the wrapper by corresponding helical strips of the wrapper being removed exposing the fibrous filtration material of the plug, and the tipping wrapper being provided with a ring of perforations disposed to communicate with said grooves at the upstream region thereof.

* * * * *